US009709308B2

(12) United States Patent
Aoyagi

(10) Patent No.: US 9,709,308 B2
(45) Date of Patent: Jul. 18, 2017

(54) HEAT PUMP DEVICE AND REFRIGERANT BYPASS METHOD

(75) Inventor: Yoshiro Aoyagi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 1194 days.

(21) Appl. No.: 13/521,856

(22) PCT Filed: Jan. 26, 2010

(86) PCT No.: PCT/JP2010/050949

§ 371 (c)(1),
(2), (4) Date: Jul. 12, 2012

(87) PCT Pub. No.: WO2011/092802

PCT Pub. Date: Aug. 4, 2011

(65) Prior Publication Data

US 2012/0291460 A1 Nov. 22, 2012

(51) Int. Cl.
*F25D 21/06* (2006.01)
*F25B 47/02* (2006.01)
(Continued)

(52) U.S. Cl.
CPC ..... *F25B 47/025* (2013.01); *F25B 40/00* (2013.01); *F25B 49/02* (2013.01); *F25B 47/022* (2013.01);
(Continued)

(58) Field of Classification Search
CPC . F25B 47/025; F25B 2339/047; F25B 47/022
See application file for complete search history.

(56) References Cited

U.S. PATENT DOCUMENTS 4,770,000 A 9/1988 Kuroda et al.
4,774,813 A * 10/1988 Yokoyama ..... F25B 13/00 62/156
(Continued)

FOREIGN PATENT DOCUMENTS

DE 3720889 A1 1/1988
EP 0 924 479 A2 6/1999
(Continued)

OTHER PUBLICATIONS

Osao et al., Air Conditioner, Sep. 11, 1998, JPH10238910A, Whole Document.*
(Continued)

*Primary Examiner* — Justin Jonaitis
*Assistant Examiner* — Larry Furdge
(74) *Attorney, Agent, or Firm* — Buchanan Ingersoll & Rooney PC

(57) ABSTRACT

An outdoor unit includes a bypass circuit that makes a part of refrigerant that is discharged from a compressor be bypassed to a connecting part at the time of defrosting operation. A control device of the outdoor unit performs control of opening an electromagnetic valve in the bypass circuit based on an water temperature TW (in) in an water inlet and an water temperature TW (out) in an water outlet of an water heat exchanger at the time of the defrosting operation. Further, a control device controls a valve travel of the valve of the third expansion valve in the bypass circuit based on a refrigerant temperature TR (in) in a refrigerant inlet and a refrigerant temperature TR (out) in a refrigerant outlet of the water heat exchanger in a case of the electromagnetic valve being in an open state at the time of the defrosting operation.

6 Claims, 5 Drawing Sheets

(51) Int. Cl.
*F25B 40/00* (2006.01)
*F25B 49/02* (2006.01)

(52) U.S. Cl.
CPC . *F25B 2339/047* (2013.01); *F25B 2341/0662* (2013.01); *F25B 2347/023* (2013.01); *F25B 2400/0403* (2013.01); *F25B 2400/0411* (2013.01); *F25B 2500/19* (2013.01); *F25B 2700/1931* (2013.01); *F25B 2700/21161* (2013.01); *F25B 2700/21162* (2013.01); *F25B 2700/21163* (2013.01); *F25B 2700/21171* (2013.01); *F25B 2700/21174* (2013.01); *F25B 2700/21175* (2013.01)

(56) References Cited

U.S. PATENT DOCUMENTS

| | | | | |
|---|---|---|---|---|
| 6,012,294 | A * | 1/2000 | Utsumi | F25B 13/00 62/156 |
| 8,020,393 | B2 | 9/2011 | Okada et al. | |
| 2005/0189431 | A1 | 9/2005 | Nakayama et al. | |
| 2007/0240872 | A1* | 10/2007 | Hayashi | F25B 41/04 165/254 |
| 2008/0092568 | A1* | 4/2008 | Ookoshi | F24D 17/02 62/151 |
| 2009/0241569 | A1 | 10/2009 | Okada et al. | |

FOREIGN PATENT DOCUMENTS

| | | | |
|---|---|---|---|
| EP | 1484561 | A1 | 12/2004 |
| EP | 1 967 801 | A2 | 9/2008 |
| JP | 60-162161 | A | 8/1985 |
| JP | 61-89450 | A | 5/1986 |
| JP | 61-191828 | A | 8/1986 |
| JP | 62-213654 | A | 9/1987 |
| JP | 63-101661 | A | 5/1988 |
| JP | 63-213752 | A | 9/1988 |
| JP | 63-286676 | A | 11/1988 |
| JP | H10238910 | A * | 9/1998 |
| JP | 2000-274892 | A | 10/2000 |
| JP | 2006-153418 | A | 6/2006 |
| JP | 200870013 | A | 3/2008 |
| JP | 2008-138921 | A | 6/2008 |
| JP | 2008-224088 | A | 9/2008 |
| JP | 2009-14298 | A | 1/2009 |
| JP | 2009-41860 | A | 2/2009 |
| JP | 2009-243793 | A | 10/2009 |

OTHER PUBLICATIONS

Office Action (Final Office Action) issued by the Japanese Patent Office on Nov. 12, 2013 in corresponding Japanese Patent Application No. 2011-551611 and partial English translation of the Official Action. (5 pages).

Japanese Office Action (Reason(s)) dated Feb. 19, 2013, issued in corresponding Japanese Patent Application No. 2011-551611, and Partial English language translation of Office Action. (4 pages).

The extended European Search Report issued on Feb. 10, 2016, by the European Patent Office in corresponding European Application No. 10844569.3. (8 pages).

International Search Report (PCT/ISA/210) Issued on Feb. 23, 2010, by the Japanese Patent Office as the International Searching Authority for International Application No. PCT/JP2010/050949.

Office Action (Communication pursuant to Article 94(3) EPC) issued on Nov. 25, 2016, by the European Patent Office in corresponding European Patent Application No. 10844569.3. (6 pages).

* cited by examiner

Fig. 3

| SUBJECT OF JUDGMENT | TEMPERATURE SENSOR | DETECTED TEMPERATURE | EXPRESSION NUMBER |
|---|---|---|---|
| START OF DEFROSTING OPERATION | TEMPERATURE SENSOR 11f | TL (f, in) ≤ −10 ℃, 180 SECS. | EXPRESSION (1) |
| START OF BYPASSING (FREEZING JUDGMENT CONDITION) | TEMPERATURE SENSOR 11a<br>TEMPERATURE SENSOR 11c | TW (a, out) ≤ 3 ℃, AND<br>TW (c, in) ≤ 10 ℃, FOR 30 SECS. | EXPRESSION (2)<br>EXPRESSION (3) |
| START OF VALVE TRAVEL CONTROL OF EXPANSION VALVE 8 | TEMPERATURE SENSOR 11b<br>TEMPERATURE SENSOR 11d | TR (b, out) < 0 ℃ OR<br>TR (d, in) < 20 ℃ | EXPRESSION (4)<br>EXPRESSION (5) |
| START OF FREQUENCY CONTROL OF COMPRESSOR 3 | TEMPERATURE SENSOR 11f | TL (f, out) < 20 ℃ | EXPRESSION (6) |
| FINISH OF BYPASS DEFROSTING OPERATION | TEMPERATURE SENSOR 11f | TL (f, out) ≥ 20 ℃, $t_1$ SECS. | EXPRESSION (7) |

HEAT PUMP DEVICE AND REFRIGERANT BYPASS METHOD

TECHNICAL FIELD

The present invention relates to a heat pump device performing a normal operation for heating water flowing in an water circuit, and a defrosting operation being a reverse cycle of the normal operation by use of circulating refrigerant.

BACKGROUND ART

Patent literature 1 as described below discloses an air conditioner equipped with an indoor-side air heat exchanger, an outdoor-side air heat exchanger and a bypass circuit. Meanwhile, Patent literature 2 discloses a heat pump type hot-water supply outdoor unit equipped with an water heat exchanger for exchanging heat between water and refrigerant, an outdoor unit side air heat exchanger and a bypass circuit. In the air conditioner of Patent literature 1, by use of the bypass circuit at the time of defrosting, defrosting is performed by making high-temperature and high-pressure refrigerant be bypassed behind the outdoor unit side air heat exchanger without making the high-temperature and high-pressure refrigerant flow on the indoor unit side, thereby the defrosting efficiency is improved. In the heat pump type hot-water supply outdoor unit of Patent literature 2, the water heat exchanger is prevented from freezing by making the refrigerant be bypassed without making the refrigerant flow in the water heat exchanger at the time of defrosting by use of the bypass circuit and an expansion valve, and the water heat exchanger is prevented from freezing by decreasing a refrigerant amount to be flown in the water heat exchanger by the bypass circuit. However, there is no description in Patent literatures 1 and 2 that the water heat exchanger is prevented from freezing by defrosting through making the bypassed refrigerant be flown in the water heat exchanger on the indoor unit side by use of the bypass circuit at the time of defrosting, and a high-efficiency operation at the time of defrosting by performing heat exchange in the water heat exchanger.

CITATION LIST

Patent Literature

Patent literature 1: JP 1988-286676 A
Patent literature 2: JP 2009-41860 A

SUMMARY OF INVENTION

Technical Problem

In a conventional heat pump type hot-water supply outdoor unit, an water heat exchanger for exchanging heat between water and refrigerant is used. Under a low outdoor temperature (an ambient temperature of an outdoor unit is below zero degrees), a defrosting operation is performed since frost is formed over an outdoor unit side air heat exchanger. At this time, heat of refrigerant is used for defrosting (heat dissipation by excessive heat exchange at the low outdoor temperature), and the temperature of the refrigerant of which heat is drawn due to defrosting becomes below zero degrees before the refrigerant flows into the water heat exchanger. There is a problem that the water heat exchanger freezes by the refrigerant with a temperature below zero degrees flowing into the water heat exchanger. At this time, the water flowing into the water heat exchanger for exchanging heat between water and refrigerator is not controlled by the heat pump type hot-water supply outdoor unit, and a system controller that controls boiling in a tank on site controls the water flowing into the water heat exchanger. Therefore, water is circulated also at the time of the defrosting operation. When the temperature on an water inlet side in the water heat exchanger becomes 10 degrees Celsius or lower, the temperature on an water outlet side becomes zero degrees Celsius or lower, hence the water heat exchanger freezes (since it becomes a reverse cycle at the time of the defrosting operation, it becomes a cooling operation).

As a solution to this problem, (1) in Patent literature 2, the bypass circuit and an electromagnetic valve are placed on an outlet side of the outdoor unit side air heat exchanger and an outlet side of the water heat exchanger to prevent refrigerant from flowing into the water heat exchanger, thereby the water heat exchanger is prevented from freezing.

(2) further, the refrigerant is flown by making the bypass circuit and the water heat exchanger be aligned in parallel, and decreasing the refrigerant amount that flows into the water heat exchanger, thereby freezing is prevented. In this way, freezing prevention of the water heat exchanger in Patent literature 2 is "freezing prevention by preventing refrigerant from flowing into the water heat exchanger by use of the bypass circuit" (above (1)), or "freezing prevention by making the bypass circuit and the water heat exchanger be aligned in parallel, and decreasing refrigerant that flows into the water heat exchanger" (above (2)).

Therefore, there are problems that the operation becomes low-efficient since heat exchange is not performed on the side of the water heat exchanger (for example, a plate heat exchanger) that is located on an indoor unit side of an air conditioner ((1) as described above), or heat exchange is not performed sufficiently in the water heat exchanger, and since heat exchange is performed only on the outdoor unit side in (1) as described above, and liquid refrigerant is returned to a compressor, compressor protection becomes incomplete.

The present invention aims to provide a heat pump device for performing a high-efficiency defrosting operation by use of an water heat exchanger that is located on an indoor unit side, while preventing freezing of the water heat exchanger at the time of a defrosting operation.

Further, the present invention aims to provide a heat pump device that performs a high-efficiency operation at the time of the defrosting operation, and protects a compressor without returning liquid refrigerant to the compressor.

Solution to Problem

The heat pump device according to the present invention is a heat pump device that performs a normal operation for heating water that flows in an water circuit and a defrosting operation that is a reverse cycle of the normal operation by using a refrigerant that circulates, the heat pump device including a main refrigerant circuit wherein a four-way valve, which is connected to each of a suction port and a discharge port of a compressor by a pipe, and which switches between the normal operation and the defrosting operation by switching a circulation direction of the refrigerant, an water heat exchanger that functions as a heat radiator that radiates heat to the water at a time of the normal operation, and that functions as a heat absorber that absorbs heat from the water at a time of the defrosting operation, a first decompression device that decompresses the refrigerant that circulates, and an air heat exchanger that functions as the heat absorber at the time of the normal operation and that functions as the heat radiator at the time of the defrosting operation are connected in this order by a pipe, and wherein the refrigerant circulates, and a bypass circuit that connects a discharge side of the compressor, and a connecting part that is a part between the first decompression device and the air heat exchanger, the bypass circuit making a part of a refrigerant that has been discharged from the compressor at the time of the defrosting operation be bypassed as a bypass refrigerant from the main refrigerant circuit to the connecting part.

Advantageous Effects of Invention

According to the present invention, it is possible to provide the heat pump device that performs a high-efficiency defrosting operation by using the water heat exchanger that is located on the indoor unit side while preventing freezing of the water heat exchanger at the time of the defrosting operation.

Further, according to the present invention, it is possible to provide the heat pump device that protects the compressor by not returning liquid refrigerant to the compressor at the time of the defrosting operation.

BRIEF DESCRIPTION OF DRAWINGS

FIG. 3 A diagram illustrating a relation between a determined object and a detected temperature according to the first embodiment.

DESCRIPTION OF EMBODIMENT

Embodiment 1

Figure 1:
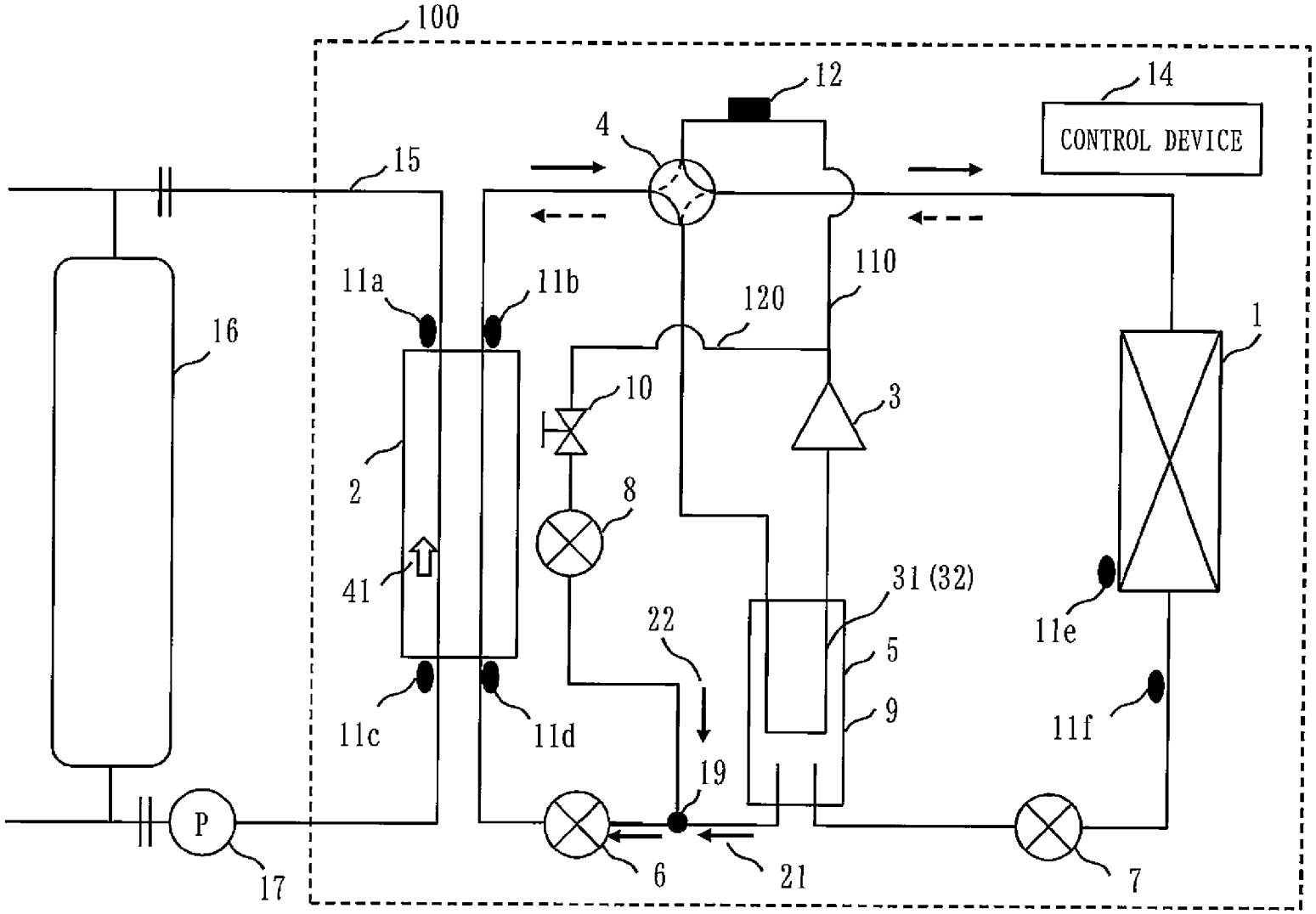
FIG. 1 A refrigerant circuit diagram describing an outdoor unit 100 in the first embodiment.

FIG. 1 is a refrigerant circuit diagram describing a heat pump type hot-water supply outdoor unit 100 (referred to as an outdoor unit 100, hereinafter) in the first embodiment. The outdoor unit 100 (heat pump device) performs, by use of circulating refrigerant, a heating hot-water supply operation (referred to as a normal operation, hereinafter) for heating water that flows in an water circuit 15 by an water heat exchanger 2, and a defrosting operation being a reverse cycle of the normal operation. In FIG. 1, a dashed arrow shows a refrigerant circulating direction in the normal operation, and a solid arrow shows the refrigerant circulating operation in the defrosting operation. Further, an arrow 41 shows a flowing direction of the water that circulates in the water circuit 15. The water circulates by an water pump 17. Here, a hot-water storage tank 16 is located in the water circuit 15.

The outdoor unit 100 includes a main refrigerant circuit 110 wherein a compressor 3, a four-way valve 4, the water heat exchanger 2, the first expansion valve 6 (the first decompression device), a medium-pressure receiver 5, the second expansion valve 7 (the second decompression device) and an air heat exchanger 1 are connected by a pipe, and a bypass circuit 120 wherein an electromagnetic valve 10 and the third expansion valve 8 (bypass refrigerant decompression device) are connected by a pipe.

Here, (1) the compressor 3 is of a type that is controlled its rotation number by an inverter, and controlled its capacity.

(2) The four-way valve 4 is connected to each of a suction port and a discharge port of the compressor 3 by a pipe, and switches between the normal operation and the defrosting operation by switching a circulation direction of the refrigerant.

(3) The water heat exchanger 2 exchanges heat between water and refrigerant. The water heat exchanger 2 is, for example, a plate heat exchanger. The water heat exchanger 2 heats water in the water circuit 15 as a heat radiator (condenser) at the time of the normal operation, and functions as a heat absorber (evaporator) that absorbs heat from the water in the water circuit 15 at the time of the defrosting operation.

(4) The first expansion valve 6 regulates the flow volume of the refrigerant and decompresses the refrigerant.

(5) A suction pipe 31 of the compressor 3 penetrates through inside of the medium-pressure receiver 5. The refrigerant in a penetrating part 32 of the suction pipe 31 of the compressor 3 and the refrigerant inside the medium-pressure receiver 5 are configured to be heat-exchangeable, and the medium-pressure receiver 5 has a function as an internal heat exchanger 9.

(6) The second expansion valve 7 regulates the flow volume of the refrigerant and decompresses the refrigerant. Here, the first expansion valve 6, the second expansion valve 7 and the third expansion valve 8 are electronic expansion valves of which valve travels are variably controlled.

(7) The air heat exchanger 1 exchanges heat between air and the refrigerant. The air heat exchanger 1 functions as a heat absorber (evaporator) at the time of the normal operation, and a heat radiator (condenser) at the time of the defrosting operation. The air heat exchanger 1 exchanges heat with outside air that is blown by a fan, etc.

(8) As a refrigerant in the outdoor unit 100, R410A or R407C that are HFC (Hydro Fluoro Carbon) based mixed refrigerants are used.

(Bypass Circuit 120)

The bypass circuit 120 is a bypass circuit that connects the discharge side of the compressor 3 and the connecting part 19 that is the part between the first expansion valve 6 and the medium-pressure receiver 5. The bypass circuit 120 makes a part of the refrigerant that is discharged from the compressor 3 at the time of the defrosting operation be bypassed as bypass refrigerant from the main refrigerant circuit 110 to the connecting part 19. Bypass refrigerant 22 joins refrigerant 21 that is flown out from the medium-pressure receiver 5, and flows into the water heat exchanger 2 via the first expansion valve 6.

The electromagnetic valve 10 turns on and off a bypass for the bypass refrigerant to be bypassed from the main refrigerant circuit 110 by being opened and closed by the control of a control device 14. The third expansion valve 8 regulates the flow volume of the bypass refrigerant that is bypassed from the main refrigerant circuit 110 and decompresses the bypass refrigerant by being controlled by the control device 14.

(Temperature Sensor)

The following temperature sensors are located in the main refrigerant circuit 110. Below, the inlet and outlet of the refrigerant are shown based on the circulation direction of the refrigerant at the time of the normal operation.

The first temperature sensor 11*a* is located on an water outlet side of the water heat exchanger 2, the second temperature sensor 11*b* on a refrigerant inlet side of the water heat exchanger 2, the third temperature sensor 11*c* on an water inlet side of the water heat exchanger 2, the fourth temperature sensor 11*d* on a refrigerant outlet side of the water heat exchanger 2, and the sixth temperature sensor 11*f* on a refrigerant inlet side of the air heat exchanger 1.

These temperature sensors measure refrigerant temperatures or water temperatures in each of the installed places.

Further, the fifth temperature sensor 11*e* measures an outside temperature surrounding the outdoor unit 100.

(Pressure Sensor 12)

A pressure sensor 12 for detecting a pressure of discharged refrigerant is installed in a pipe that connects the discharge side of the compressor 3 and the four-way valve 4. Here, since the pipe between the pressure sensor 12 and the water heat exchanger 2 or the air heat exchanger 1 is short, pressure loss is small, and the pressure detected by the pressure sensor 12 can be recognized as equivalent to a condensation pressure of the refrigerant inside the water heat exchanger 2 or inside the air heat exchanger 1. A condensation temperature of the refrigerant is calculated by the control device 14 from a condensation pressure that is detected by the pressure sensor 12.

(Control Device 14)

The control device 14 is installed inside the outdoor unit 100. The control device 14 controls an operation method of the compressor 3, a channel switching in the four-way valve 4, an airflow volume of a fan in the air heat exchanger 1, and the valve travels of the first expansion valve 6, the second expansion valve 7, the third expansion valve 8 and the electromagnetic valve 10, etc based on measurement information of each of the temperature sensors 11*a* through 11*f* and the pressure sensor 12, and an operation content that is directed by a user of the outdoor unit 100.

(Explanation of Actions)

Next, actions of the outdoor unit 100 will be explained. First, actions at the time of the normal operation by the outdoor unit 100 will be described with reference to FIG. 1. As mentioned above, the devices to be controlled, such as the compressor 3, the electronic expansion valves, etc. are controlled by the control device 14.

Figure 2:
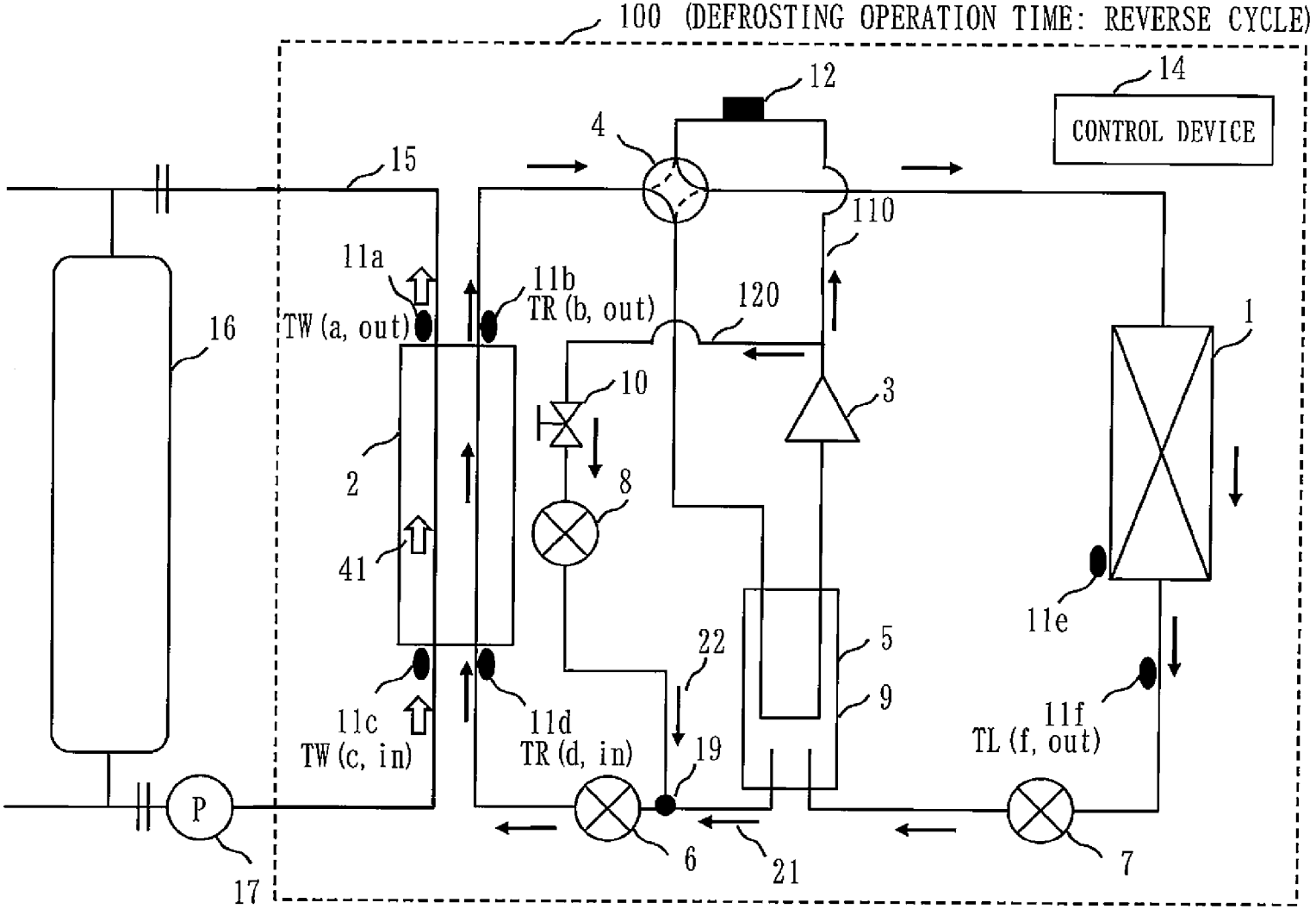
FIG. 2 A diagram describing a circulating direction of refrigerant at the time of the defrosting operation in the outdoor unit 100 according to the first embodiment.
Figure 4:
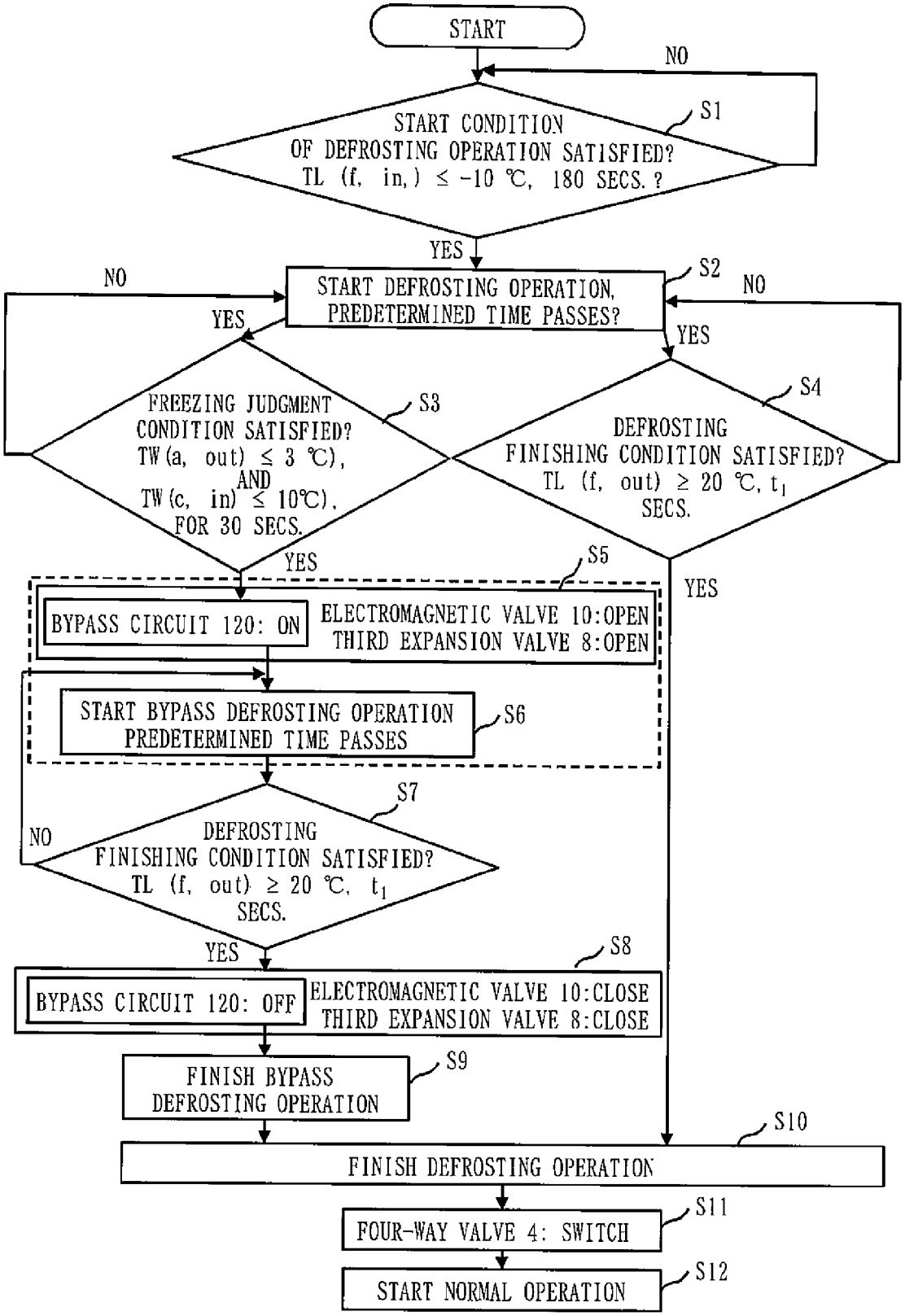
FIG. 4 A flow chart describing operations in a normal defrosting operation according to the first embodiment.
Figure 5:
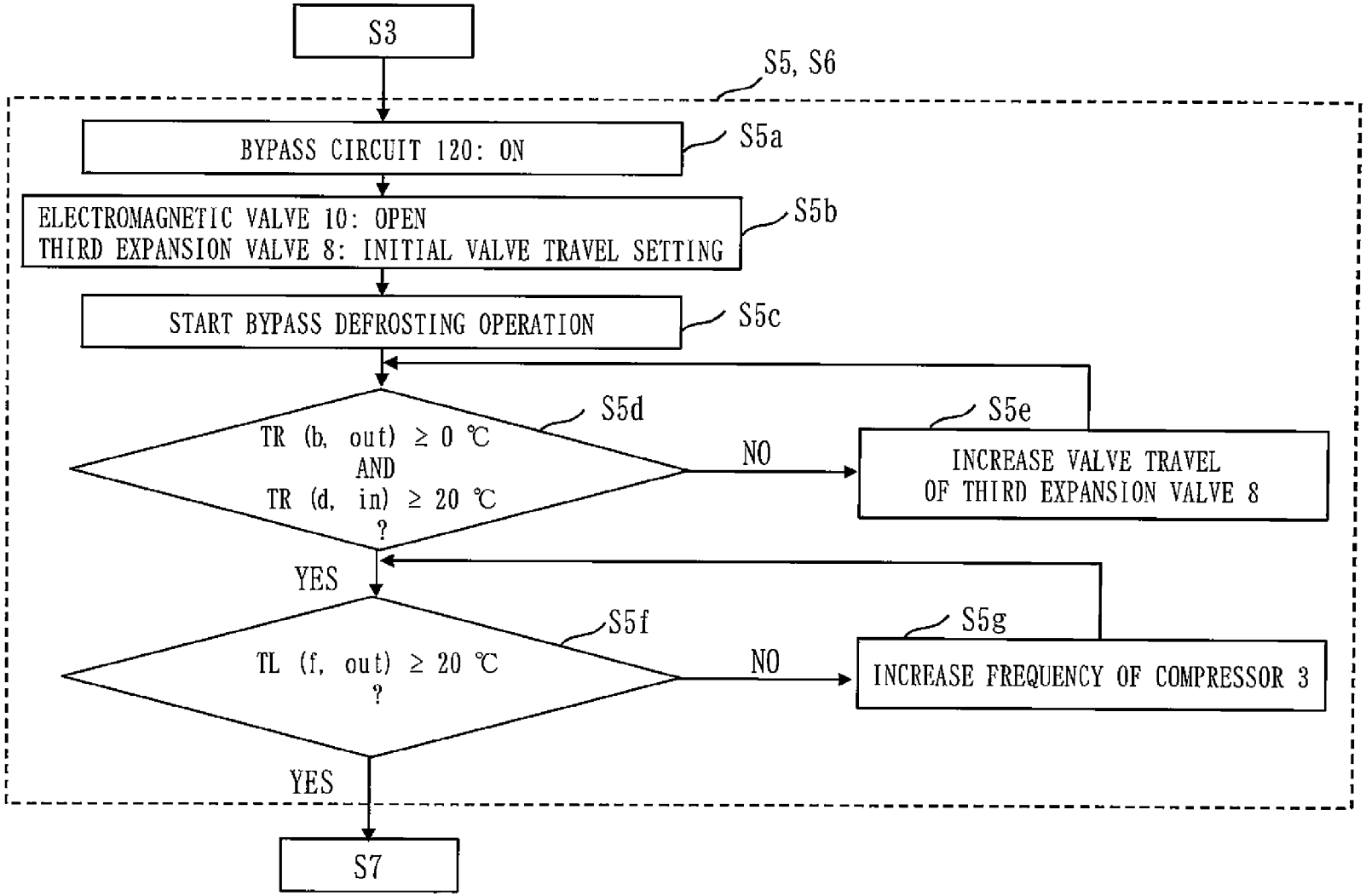
FIG. 5 A flow chart describing a bypass defrosting operation according to the first embodiment.

Here, although an explanation will be provided by using specific values for temperatures detected by each temperature sensor and detection times of the temperatures, etc. below, these values are just one example, and the temperatures and the detection times, etc. are not limited to these values. In the following explanation of the operations, circulation directions of refrigerant at the time of the defrosting operation in FIG. 2 are specifically described. Further, a correspondence between a determined object and a detected temperature at the time when the control device 14 performs control is shown in FIG. 3. FIGS. 4 and 5 are operational flow charts of the outdoor unit 100. The actions of the control device 14 will be described below with reference to FIGS. 2 through 5. The outdoor unit 100 has a characteristic that refrigerant is bypassed at the time of the defrosting operation.

(1. Action in the Normal Operation)

The flow channel of the four-way valve 4 at the time of the normal operation is set in a dashed line direction as shown in FIG. 1. That is, by the setting of the four-way valve 4, the refrigerant circulates in order of the compressor 3, the four-way valve 4, the water heat exchanger 2, the first expansion valve 6, the medium-pressure receiver 5, the second expansion valve 7, the air heat exchanger 1, the four-way valve 4, the medium-pressure receiver 5 and the compressor 3 at the time of the normal operation.

(1) High-temperature and high-pressure gas refrigerant that is discharged from the compressor 3 flows into the water heat exchanger 2 via the four-way valve 4. Then, the gas refrigerant that has flowed in the water heat exchanger 2 is condensed to liquid while dissipating heat in the water heat exchanger 2 functioning as a condenser, and becomes high-pressure and low-temperature liquid refrigerant. By the heat dissipated from the refrigerant passing through the water heat exchanger 2, water on a load side (water that flows through the water circuit 15) that passes through the water heat exchanger 2 is heated.

(2) The high-pressure and low-temperature liquid refrigerant that has been released from the water heat exchanger 2 is slightly decompressed by the first expansion valve 6 to be in a gas-liquid two-phase state, and flows into the medium-pressure receiver 5.

(3) The refrigerant that has flown into the medium-pressure receiver 5 provides heat to low-temperature refrigerant that flows in the suction pipe 31 of the compressor 3 inside the medium-pressure receiver 5 to be cooled to become liquid, and flows out from the medium pressure receiver 5.

(4) The liquid refrigerant that has flown out from the medium-pressure receiver 5 is decompressed to a low pressure by the second expansion valve 7 to become two-phase refrigerant, and then flows in the air heat exchanger 1 that functions as an evaporator, and absorbs heat from air in the air heat exchanger 1 to be evaporated and gasified.

(5) The gasified refrigerant is directed to the four-way valve 4 from the air heat exchanger 1, passes through the four-way valve 4, exchanges heat with high-pressure refrigerant in the medium-pressure receiver 5, and is heated further to be taken in by the compressor 3.

(Action in the Defrosting Operation)

FIG. 2 is a refrigerant circuit diagram describing a flow of refrigerant in the defrosting operation of the outdoor unit 100. Whereas the circuit structure in FIG. 2 is the same as in FIG. 1, in comparison with FIG. 1, a solid arrow that shows a flowing direction of the refrigerant in the defrosting operation is shown in detail. The action in the defrosting operation of the outdoor unit 100 will be described next with reference to FIG. 2.

When a detected temperature TL (f, in) of the sixth temperature sensor 11*f* of the air heat exchanger 1 satisfies the following expression (1), which is a judgment expression for starting the defrosting operation, for at least 180 seconds, it is detected that frost is formed on the air heat exchanger 1, and the control device 14 shifts the operation to the defrosting operation from the normal operation.

$$TL(f,\text{in},) \leq -10^\circ\ \text{C}. \quad (1)$$

The detected temperature TL (f, in) in the expression (1) is a temperature in the normal operation. Thus, the detected temperature TL (f, in) in the expression (1) is an inlet temperature of the refrigerant to the air heat exchanger 1.

(1) The high-temperature and high-pressure gas refrigerant that is discharged from the compressor 3 defrosts the air heat exchanger 1 whereon frost is formed via the four-way valve 4, flows out from the air heat exchanger 1 as liquid refrigerant to be brought into a gas-liquid two-phase state via the second expansion valve 7, becomes liquid refrigerant via the medium-pressure receiver 5, then is brought into a gas-liquid two-phase state via the first expansion valve 6, and flows into the water heat exchanger 2 (evaporator).

(2) The refrigerant that has flown into the water heat exchanger 2 vaporizes in the water heat exchanger 2 by being provided heat from hot-water in the water circuit 15 that passes through the water heat exchanger 2, passes through the four-way valve 4 and the medium-pressure receiver 5, and returns to the compressor 3. By the circulation of the refrigerant, the air heat exchanger 1 is defrosted. The action in the defrosting operation is defrosting by a reverse cycle (cooling operation).

Since the reverse cycle is processed at the time of the defrosting operation, the operation becomes a cooling operation for the water heat exchanger 2. In this case, when a refrigerant temperature that flows in the water heat exchanger 2 decreases (when the temperature becomes below zero degrees) by decline in ambient air of the air heat exchanger 1, or when an water inlet temperature of the water heat exchanger 2 becomes 10° Cs or less, there is a possibility that an water outlet temperature of the water heat exchanger 2 becomes 0° C. or less, and that the water heat exchanger 2 freezes. However, even when the water heat exchanger 2 might freeze, the system controller (not shown in the diagrams) that controls boiling in the hot-water storage tank 16 makes water in the water circuit 15 circulate by actuating the water pump 17 regardless of the threat of freezing of the water heat exchanger 2. Thus, the outdoor unit 100 controls freezing prevention.

(Bypassing by the Bypass Circuit 120)

With respect to the threat of freezing of the water heat exchanger 2, at the time of the defrosting operation, the control device 14 opens the electromagnetic valve 10 and the third expansion valve 8 inside the bypass circuit 120, and makes part of the high-temperature and high-pressure refrigerant that has been discharged from the compressor 3 be bypassed to the connecting part 19 between the medium-pressure receiver 5 and an upstream part of the first expansion valve 6 via the bypass circuit 120. In the outdoor unit 100, the refrigerant 21 flowing in the main refrigerant circuit 110 that has flowed out from the medium-pressure receiver 5 and the refrigerant 22 that is bypassed to the bypass circuit 120 are mixed. The mixed refrigerant flows in the water heat exchanger 2 via the first expansion valve 6. By the mixing, it becomes possible to suppress decrease in the temperature of the refrigerant that flows in the water heat exchanger 2, and to prevent freezing of the water heat exchanger 2.

At this time, the control device 14 carries out control of the electromagnetic valve 10, the third expansion valve 8, etc. based on the detected temperatures by the temperature sensors 11*c* (water inlet side) and 11*d* (refrigerant inlet side), etc. so that the refrigerant temperature flowing into the water heat exchanger 2 can be maintained at a temperature (for example, 20° C. or more) that does not freeze the water heat exchanger 2. This will be explained later.

The defrosting operation using the bypass circuit 120 can become a highly-efficient operation by heat exchange (transfer of heat from hot water to refrigerant) performed in the water heat exchanger 2. Further, since it is possible to make the state of the refrigerant be gasified by performing heat exchange in the water heat exchanger 2, the compressor 3 can be protected.

(3. Action Outline of the Defrosting Operation using the Bypass Circuit 120)

Next, it will be described the control actions in the defrosting operation using the bypass circuit 120 by the outdoor unit 100 with reference to FIG. 2.

(About Temperature Symbols)

Below, a temperature "flowing in or flowing out" of "refrigerant or water" to the heat exchanger that is detected by a temperature sensor will be described as TW (a, out), and so on.

Here,

"a" describes a temperature sensor being an origin of detection,

"out" describes flowing out from the heat exchanger, and

"in" describes flowing in the heat exchanger.

Further, "TW" (the water heat exchanger 2) describes an water temperature, and "TR" (the water heat exchanger 2) and "TL" (the air heat exchanger 1) describe refrigerant temperatures.

A detected temperature of each temperature sensor at the time of the defrosting operation is as follows.

(1) The first temperature sensor 11*a* is placed on the water outlet side of the water heat exchanger 2, detecting an water outlet temperature TW (a, out).

(2) The second temperature sensor 11*b* is placed on the refrigerant outlet side of the water heat exchanger 2, and detecting a refrigerant outlet temperature TR (b, out).

(3) The third temperature sensor 11*c* is placed on the water inlet side of the water heat exchanger 2, detecting an water inlet temperature TW (c, in).

(4) The fourth temperature sensor 11*d* is placed on the refrigerant inlet side of the water heat exchanger 2, detecting a refrigerant inlet temperature TR (d, in).

When the temperature TW (a, out), the temperature TW (c, in), the temperature TR (b, out) and the temperature TR (d, in) related to the water heat exchanger 2 decline, there is a possibility that the water heat exchanger 2 freezes.

Thus, the control device 14 opens the third expansion valve 8 and the electromagnetic valve 10 in the bypass circuit, and makes part of refrigerant Grb (for example, 30% of an entire circulation amount Gr) be bypassed only when it is detected that the following expressions (2) and (3) are maintained for 30 seconds at the same time. The expressions (2) and (3) are judgment expressions (also referred to as freezing judgment conditions) for starting bypassing.

$$\text{Temperature } TW(a,\text{out}) \leq 3^\circ \text{ C.} \quad (2)$$

$$\text{Temperature } TW(c,\text{in}) \leq 10^\circ \text{ C.} \quad (3)$$

As for the bypass refrigerant Grb (refrigerant 22), the bypass amount is determined by a valve travel P of the third expansion valve 8. Since the bypass refrigerant Grb is made to flow into the connecting part 19 between the medium-pressure receiver 5 and the upstream part of the first expansion valve 6, the third expansion valve 8 decompresses the bypass refrigerant Grb. Namely, the bypass refrigerant Grb is made to a middle pressure from a high pressure by the third expansion valve 8. The refrigerant Gra (refrigerant 21) that has flown in the main refrigerant circuit 110 is mixed with the bypass refrigerant Grb (refrigerant 22) that has been bypassed and decompressed. The mixed refrigerant flows in the water heat exchanger 2 via the first expansion valve 6. The control device 14 controls the third expansion valve 8 so that the refrigerant inlet temperature TR (d, in) and the refrigerant outlet temperature TR (b, out) at the water heat exchanger 2 of the mixed refrigerant satisfy:

$$TR(d,\text{in}) \geq 20^\circ \text{ C. and } TR(b,\text{out}) \geq 0^\circ \text{ C.}$$

The third expansion valve 8 will be described in the explanation with reference to FIG. 5. After heat exchange is performed in the water heat exchanger 2, the refrigerant is gasified, heat exchanged with middle-pressure refrigerant in the middle-pressure receiver 5, heated further and taken in the compressor 3.

(4. Specific Actions in the Defrosting Operation)

Next, specific control actions of the operation at the time of defrosting in the outdoor unit 100 will be explained with reference to FIG. 4. FIG. 4 is a flowchart describing the control actions by the control device 14 at the time of the defrosting operation.

When the sixth temperature sensor 111 of the air heat exchanger 1 detects a temperature TL (f, in) that fulfills the above expression (1) (TL (f, in)≤−10° C.) for 180 seconds, the control device 14 starts the defrosting operation (reverse cycle operation) (S1).

(Freezing Judgment Condition)

When the freezing judgment condition (the expressions (2) and (3)) is detected by the first temperature sensor 11*a* and the third temperature sensor 11*c* after the defrosting operation is started, the control device 14 opens the electromagnetic valve 10 and the third expansion valve 8 of the bypass circuit 120 (S3, S5). Below, the defrosting operation using the bypass circuit 120 is referred to as a bypass defrosting operation. That is, the freezing judgment condition is a condition to start the bypass defrosting operation. When the freezing judgment condition is not detected, the control device 14 continues detection of the freezing judgment condition while continuing the normal defrosting operation.

Here, it is explained the case wherein both the temperatures TW (a, out) and TW (c, in) are used for the freezing judgment condition, which is only one example. It is only necessary that at least any one of the temperatures TW (a, out) and TW (c, in) is used for the freezing judgment condition. It is of course preferable to use both the temperatures.

(Bypass Circuit 120)

In a conventional defrosting operation, as for an outlet temperature TL (out) of liquid refrigerant of the air heat exchanger 1 (condenser), when it is detected the outlet temperature TL (out) that satisfies:

$$\text{outlet temperature } TL(\text{out}) \geq 20^\circ \text{ C.},$$

the defrosting operation is finished, and the normal operation is started again by switching the four-way valve 4.

That is, conventionally, the defrosting operation has been performed until "outlet temperature TL (out)≥20° C." was satisfied with or without the threat of freezing in the water heat exchanger 2. Therefore, the water heat exchanger 2 could have frozen before "outlet temperature TL (out)≥20° C." was detected. However, in the outdoor unit 100, the control device 14 also performs detection of the freezing judgment condition as shown on the left side (S3) in the flow of FIG. 4 while monitoring whether "outlet temperature TL (f, out) is no less than 20° C. as shown on the right side (S4) in the flow of FIG. 4. Since the outlet temperature TL (out) of the liquid refrigerant of the air heat exchanger 1 (condenser) is detected by the temperature sensor 11*f* in the outdoor unit 100, the outlet temperature TL (out) is described as "TL (f, out)." The control device 14 opens the electromagnetic valve 10 and the third expansion valve 8, and performs the bypass defrosting operation which makes high-temperature and high-pressure refrigerant be bypassed when the freezing judgment condition is detected before "outlet temperature TL (f, out)≥20° C." is detected. Thus, freezing of the water heat exchanger 2 can be prevented at the time of the defrosting operation.

(5. Actions in the Bypass Defrosting Operation)

FIG. 5 is a flow chart describing control actions during the bypass defrosting operation at the time of the defrosting operation. FIG. 5 describes specific contents of S5 and S6 in FIG. 4 as S5*a* through S5*g*.

The control action of the bypass circuit 120 (the electromagnetic valve 10, the third expansion valve 8) by the outdoor unit 100 will be described with reference to FIG. 5.

The control device 14 opens the electromagnetic valve 10 and the third expansion valve 8 to activate the bypass circuit 120, and makes a high-temperature and high-pressure refrigerant that has been discharged from the compressor 3 be bypassed to the bypass circuit 120 (S5*a*, S5*b*, S5*c*). At this time, the third expansion valve 8 is controlled to have a predetermined valve travel. The control device 14 makes the refrigerant be bypassed to the bypass circuit 120 (S5*d*) while controlling operating frequency of the compressor 3 aiming at satisfying:

$$TR(b,\text{out}) \geq 0^\circ \text{ C. and } TR(d,\text{in}) \geq 20^\circ \text{ C.}$$

The control device 14 increases bypassing amount of the refrigerant by changing the valve travel (increasing the valve travel) of the third expansion valve 8 when the following expression (4) or (5) is detected, and controls the valve travel P of the third expansion valve 8 so as to satisfy the following expressions (4) and (5) (S5*e*). Namely, the condition of "the expression (4) or (5)" is a condition to start control of the third expansion valve 8 as shown in FIG. 3.

$$TR(b,\text{out}) < 0^\circ \text{ C.} \tag{4}$$

or $$TR(d,\text{in}) < 20^\circ \text{ C.} \tag{5}$$

When "TR (b, out)≥0° C. and TR (d, in)≥20° C." is satisfied, the control of the control device 14 proceeds to S5*f*.

Here, although it is explained the case of using both the temperatures TR (b, out) and TR (d, in) for control of the valve travel of the third expansion valve 8, this is only one example. It is only necessary for control of the valve travel of the third expansion valve 8 to use at least either of the temperatures TR (b, out) and TR (d, in). It is of course preferable to use both the temperatures.

The control device 14 aims at "TL (f, out)≥20° C." in the air heat exchanger 1 (5*f*).

When it is $$TL(f,\text{out}) < 20^\circ \text{ C.} \tag{6},$$

the control device 14 increases the compressor frequency so as to satisfy $$TL(f,\text{out}) \geq 20^\circ \text{ C.}(S5g).$$

Thus, as shown in FIG. 3, "expression (6)" is a condition to control the operating frequency of the compressor 3.

In S5*f*, when TL (f, out)≥20° C. is detected, the process of the control device 14 proceeds to S7.

Here, the control device 14 judges control of the operating frequency of the compressor 3 in S5*g*, i.e., based on the temperature TL (f, out) as the refrigerant temperature on the refrigerant outlet side of the air heat exchanger 1 in the defrosting operation. However, it is not limited to this, and the control device 14 may perform control of the operating frequency of the compressor 3 based on the refrigerant inlet side temperature (TL (in)) of the air heat exchanger 1 in the defrosting operation.

In S7, the control device 14 determines whether $$TL(f,\text{out}) \geq 20^\circ \text{ C.} \quad (7)$$

continues for $t_1$ seconds as a final confirmation of the bypass defrosting operation. As shown in FIG. 3, "expression (7)" is a judgment condition for finishing the bypass defrosting operation. When it is determined to be finished, the control device 14 closes the electromagnetic valve 10 and the third expansion valve 8, turns the bypass circuit 120 OFF (S8), and finishes the bypass defrosting operation (S9). Then, the control device 14 finishes the defrosting operation (S10), switches the four-way valve 4 (S11), and starts the normal operation again (S12).

(Backing Up of Defrosting: S5*f*, S5*g*)

As shown above, in the defrosting operation, when TW (a, out), TW (c, in), TR (b, out) and TR (d, in) decrease, and there is a threat of freezing of the water heat exchanger 2, the part Grb of the high-temperature and high-pressure refrigerant that has been discharged from the compressor 3 is made to be bypassed to the bypass circuit 120, and freezing of the water heat exchanger 2 is prevented. Meanwhile, for this bypassing, a refrigerant amount (heat quantity) for melting frost that is formed in the air heat exchanger 1 decreases and a heat exchange amount in the air heat exchanger 1 decreases. Therefore, as explained for S5*f* and S5*g*, the control device 14 increases a refrigerant circulation amount by increasing the operating frequency of the compressor 3 (S5*g*) and backs up defrosting.

When the freezing judgment condition (the expression (2) and (3)) of the water heat exchanger 2 is detected, the control device 14 continues the above-mentioned control until termination (S9) after transition to the bypass defrosting operation (S3).

As mentioned above, in the outdoor unit 100 according to the first embodiment, when a temperature of hot water flowing in the water heat exchanger 2 decreases during the defrosting operation, the bypass defrosting operation is started (S3 in FIG. 4). In the bypass defrosting operation, bypass refrigerant that has been discharged from the compressor 3 and made to be bypassed, and refrigerant that has flown from the main refrigerant circuit 110 are mixed and made to flow in the water heat exchanger 2, hence decrease in the refrigerant temperature flowing in the water heat exchanger 2 is suppressed. Thus, freezing of the water heat exchanger 2 is prevented. Further, when the refrigerant temperature flowing in the water heat exchanger 2 decreases by a low ambient temperature, the valve travel of the third expansion valve 8 is increased in the bypass defrosting operation (S5*e* in FIG. 5), hence the bypass refrigerant amount can be increased. Furthermore, by performing heat exchange with the water heat exchanger 2, it is possible to promote the efficiency in the defrosting operation. In addition, since superheat of the refrigerant that is taken in the compressor 3 can be obtained by performing heat exchange with the water heat exchanger 2, it is possible to promote protection of the compressor.

REFERENCE SIGNS LIST

1 Air heat exchanger, 2 Water heat exchanger, 3 Compressor, 4 Four-way valve, 5 Middle-pressure receiver, 6 First expansion valve, 7 Second expansion valve, 8 Third expansion valve, 10 Electromagnetic valve, 11*a* First temperature sensor, 11*b* Second temperature sensor, 11*c* Third temperature sensor, 11*d* Fourth temperature sensor, 11*e* Fifth temperature sensor, 11*f* Sixth temperature sensor, 12 Pressure sensor, 14 Control device, 15 Water circuit, 16 Hot-water storage tank, 17 Water pump, 19 Connecting part, 100 Outdoor unit, 110 Main refrigerant circuit, 120 Bypass circuit.

The invention claimed is:

1. A heat pump device that performs a normal operation for heating water that flows in a water circuit and a defrosting operation that is a reverse cycle of the normal operation by using a refrigerant that circulates, the heat pump device comprising:

a main refrigerant circuit wherein a four-way valve, which is connected to each of a suction port and a discharge port of a compressor by a pipe, and which switches between the normal operation and the defrosting operation by switching a circulation direction of the refrigerant;

a water heat exchanger that functions as a heat radiator that radiates heat to the water at a time of the normal operation, and that functions as a heat absorber that absorbs heat from the water at a time of the defrosting operation;

a first decompression device that decompresses the refrigerant that circulates;

and an air heat exchanger that functions as the heat absorber at the time of the normal operation and that functions as the heat radiator at the time of the defrosting operation are connected in this order by a pipe, and wherein the refrigerant circulates;

a bypass circuit connected between a discharge side of the compressor and an intake side of the four-way valve, and a connecting part that is connected between the first decompression device and the air heat exchanger, the bypass circuit making a part of a refrigerant that has been discharged from the compressor at the time of the defrosting operation be bypassed as a bypass refrigerant from the main refrigerant circuit to the connecting part;

a flow volume regulating part that is located in the bypass circuit between the discharge side of the compressor and the connecting part and that can regulate a flow volume of the bypass refrigerant; and a control device that detects whether a predetermined freezing judgment condition is satisfied while monitoring whether a finishing condition of the defrosting operation is satisfied at the time of the defrosting operation, finishes the defrosting operation when detecting that the finishing condition of the defrosting operation is satisfied, and starts bypassing of the bypass refrigerant to the bypass circuit by starting control of the flow volume regulating part when detecting that the freezing judgment condition is satisfied, wherein the flow volume regulating part comprises an electromagnetic valve that switches on and off a bypass of the bypass refrigerant by being controlled and being opened and closed, and a bypass refrigerant decompression device that decompresses a bypass refrigerant that has passed the electromagnetic valve by regulating a flow volume of the bypass refrigerant, and wherein the control device judges whether the predetermined freezing judgment condition is satisfied based on both temperatures of a water temperature TW (in) in a water inlet and a water temperature TW (out) in a water outlet of the water heat exchanger at the time of the defrosting operation, and starts bypassing of the bypass refrigerant to the bypass circuit by performing control of opening the electromagnetic valve and the bypass refrigerant decompression device when judging that the predetermined freezing judgment condition is satisfied.

2. The heat pump device as defined in claim 1, wherein the bypass refrigerant decompression device can regulate the flow volume of the bypass refrigerant by being controlled, and wherein the control device continues control of the flow volume by the bypass refrigerant decompression device when the bypass refrigerant flows in the bypass circuit, based on at least either of a refrigerant temperature TR (in) in a refrigerant inlet or a refrigerant temperature TR (out) in a refrigerant outlet of the water heat exchanger, so that either one of refrigerant temperatures is within a predetermined temperature range in a case based on the either one of the refrigerant temperatures, or so that the refrigerant temperature TR (in) and the refrigerant temperature TR (out) are within predetermined temperature ranges in a case based on both of the refrigerant temperature TR (in) and the refrigerant temperature TR (out), when either or both of the refrigerant temperatures comes/come to be included in the predetermined temperature range/ranges, finishes controlling of the flow volume by the bypass refrigerant decompression device, and starts control of increasing an operating frequency of the compressor based on at least either of a refrigerant temperature TL (in) in a refrigerant inlet or a refrigerant temperature TL (out) in a refrigerant outlet of the air heat exchanger.

3. The heat pump device as defined in claim 1, wherein the control device performs control of closing the electromagnetic valve based on at least any of a refrigerant temperature TL (in) in a refrigerant inlet or a refrigerant temperature TL (out) in a refrigerant outlet of the air heat exchanger in a case wherein the electromagnetic valve is in an open state at the time of the defrosting operation.

4. The heat pump device as defined in claim 1, wherein in the main refrigerant circuit, a receiver is located in a halfway of the pipe between the first decompression device and the air heat exchanger, and a second decompression device that decompresses the refrigerant that circulates is located in a halfway of the pipe between the receiver and the air heat exchanger.

5. The heat pump device as defined in claim 4, wherein in the receiver, through an inside of which a part of the pipe that is directed to the suction port of the compressor from the four-way valve penetrates, and a refrigerant that flows in the part of the pipe that penetrates exchanges heat with a refrigerant that flows in from the second decompression device at the time of the defrosting operation.

6. A refrigerant bypass method, for a heat pump device that performs a normal operation for heating water that flows in a water circuit and a defrosting operation that is a reverse cycle of the normal operation by using a refrigerant that circulates, the heat pump device including a main refrigerant circuit in which a four-way valve, which is connected to each of a suction port and a discharge port of a compressor by a pipe, and which switches between the normal operation and the defrosting operation by switching a circulation direction of the refrigerant, a water heat exchanger that functions as a heat radiator that radiates heat to the water at a time of the normal operation, and that functions as a heat absorber that absorbs heat from the water at the time of the defrosting operation, a first decompression device that decompresses the refrigerant that circulates, and an air heat exchanger that functions as the heat absorber at the time of the normal operation and that functions as the heat radiator at the time of the defrosting operation are connected in this order by a pipe, and in which the refrigerant circulates; a bypass circuit that is connected between a discharge side of the compressor and an inlet of the four-way valve and a connecting part that is connected between the first decompression device and the air heat exchanger, the bypass circuit making a part of a refrigerant that has been discharged from the compressor at the time of the defrosting operation be bypassed as a bypass refrigerant from the main refrigerant circuit to the connecting part; and a flow volume regulating part that is located in the bypass circuit between the discharge side of the compressor and the connecting part and that can regulate a flow volume of the bypass refrigerant, the flow volume regulating part comprises an electromagnetic valve that switches on and off a bypass of the bypass refrigerant by being controlled and being opened and closed, and a bypass refrigerant decompression device that decompresses a bypass refrigerant that has passed the electromagnetic valve by regulating a flow volume of the bypass refrigerant; and a control device configured to perform the method, the method comprising detecting whether a predetermined freezing judgment condition is satisfied while monitoring whether a finishing condition of the defrosting operation is satisfied at the time of the defrosting operation;

finishing the defrosting operation when detecting that the finishing condition of the defrosting operation is satisfied; and bypassing the bypass refrigerant to the bypass circuit by starting control of the flow volume regulating part when detecting that the freezing judgment condition is satisfied, wherein the control device judges whether the predetermined freezing judgment condition is satisfied based on both temperatures of a water temperature TW (in) in a water inlet and a water temperature TW (out) in a water outlet of the water heat exchanger at the time of the defrosting operation, and starts bypassing of the bypass refrigerant to the bypass circuit by performing control of opening the electromagnetic valve and the bypass refrigerant decompression device when judging that the predetermined freezing judgment condition is satisfied.

* * * * *